US006257301B1

(12) United States Patent
Conforti

(10) Patent No.: US 6,257,301 B1
(45) Date of Patent: Jul. 10, 2001

(54) MODULAR WINDOW BLIND OR SHADE ASSEMBLY

(75) Inventor: Michael J. Conforti, Clearwater, FL (US)

(73) Assignee: International Wood Shutters, Inc., Tampa, FL (US)

( * ) Notice: Subject to any disclaimer, the term of this patent is extended or adjusted under 35 U.S.C. 154(b) by 0 days.

(21) Appl. No.: 09/532,762

(22) Filed: Mar. 22, 2000

Related U.S. Application Data

(63) Continuation-in-part of application No. 09/126,788, filed on Jul. 31, 1998, now abandoned.

(51) Int. Cl.[7] ..... A47H 5/00

(52) U.S. Cl. ..... 160/84.07; 160/84.01; 160/84.03; 52/204.61

(58) Field of Search ..... 160/84.01, 84.07, 160/127, 134, 162, 163, 164; 52/85, 204.6, 204.61, 456, 473

(56) References Cited

U.S. PATENT DOCUMENTS

| | | | | |
|---|---|---|---|---|
| 229,226 | | 6/1880 | Rolfe . | |
| 247,349 | | 9/1881 | Hill . | |
| 289,832 | | 12/1883 | Hartman . | |
| 1,609,877 | | 12/1926 | Kendall . | |
| 3,394,518 | | 7/1968 | Worrell, Jr. . | |
| 4,050,366 | | 9/1977 | Wiklund et al. . | |
| 4,251,966 | | 2/1981 | Foltman . | |
| 4,825,611 | | 5/1989 | Bassett . | |
| 5,010,939 | * | 4/1991 | King | 160/84.07 |
| 5,050,661 | * | 9/1991 | Sikkema et al. | 160/84.07 |
| 5,159,966 | | 11/1992 | Fleishman et al. . | |
| 5,183,092 | | 2/1993 | Jelic . | |
| 5,341,864 | * | 8/1994 | Rupel et al. | 160/84.03 |
| 5,471,789 | | 12/1995 | Faircloth . | |
| 5,584,329 | * | 12/1996 | Thomas | 160/84.07 X |
| 5,662,153 | * | 9/1997 | Rosenblatt | 160/84.07 |
| 5,673,526 | | 10/1997 | Schiedegger et al. . | |
| 5,765,619 | | 6/1998 | Arnold . | |
| 5,782,051 | * | 7/1998 | LaVoie | 52/473 |
| 5,794,680 | * | 8/1998 | Xue | 160/84.07 |
| 5,823,241 | * | 10/1998 | Sitzes et al. | 52/204.61 X |
| 5,987,836 | | 11/1999 | Sullivan . | |
| 6,029,733 | * | 2/2000 | Xue | 160/84.07 |

* cited by examiner

*Primary Examiner*—Jerry Redman
*Assistant Examiner*—Bruce A. Lev
(74) *Attorney, Agent, or Firm*—Larson & Larson, P.A.; James E. Larson

(57) ABSTRACT

A modular window shade assembly has two embodiments. One includes a frame with a generally arcuate opening containing a blind system with horizontal slats that may be pivoted to control transmission of light through the opening. In the other embodiment, an arcuate portion contains a fixed fan shade within the arcuate opening. In each of the embodiments, the frame is sized and configured to fit within an existing window opening juxtaposed to the window for easy assembly. A decorative molding is provided to be installed within the inner walls of the existing window frame to provide an aesthetic appearance in front of the shade assembly as installed.

14 Claims, 14 Drawing Sheets

MODULAR WINDOW BLIND OR SHADE ASSEMBLY

PRIOR APPLICATIONS

This application is a continuation-in-part from application Ser. No. 09/126,788, filed on Jul. 31, 1998, now abandoned.

BACKGROUND OF THE INVENTION

The present invention relates to a modular window blind or shade assembly. In the prior art, it is well known to add shades, blinds and other window treatments to an existing window having its own frame. However, installation of such devices is often difficult and cumbersome and, in many cases, the results are less than satisfactory, particularly when the installed window treatments do not fit properly within the opening in which they are installed.

As such, a need has developed for a system allowing installation of window treatments within the existing frame of the window in such a manner that installation time is drastically reduced while the quality of the finished product, as installed, is improved. It is with this need in mind that the present invention was developed.

The following prior art is known to Applicant:

U.S. Pat. No. 1,609,877 to Kendall discloses a circle head window shade including a semi-circular shade mounted within a corresponding arched-like portion of a window frame and including a centrally located curved bar designed to guide movements of the shade in an arcuate fashion.

U.S. Pat. No. 4,825,611 to Bassett discloses a drapery rod assembly for architectural apertures that includes a peripheral arcuate rod designed to receive peripheral portions of a semi-circular drape.

U.S. Pat. No. 5,183,092 to Jelic discloses an arched window blind with a specific cording design and including a track to which is attached a fitting affixed to an end of the blind to allow controllable pivoting movements thereof.

U.S. Pat. No. 5,471,789 to Faircloth discloses an arched shutter assembly including a semi-circular support for a semi-circular set of louvers that may be pivoted between open and closed positions therewithin.

The present invention differs from the teachings of these patents as contemplating, in one aspect, an arcuate frame designed to hold a correspondingly sized shade that is guided in a peripheral channel.

SUMMARY OF THE INVENTION

The present invention relates to a modular window blind or shade assembly. The present invention includes the following interrelated objects, aspects and features:

(1) In a first aspect, the present invention contemplates two embodiments of self-contained modular shade systems including a generally rectangular opening containing a blind system with horizontal slats that may be pivoted or reciprocated, or both, to control transmission of light through the opening. In each of these embodiments, above the generally rectangular portion is an arcuate portion containing a further blind. In one of the embodiments, the further blind includes a plurality of horizontal slats that may be pivoted to control light transmission. In the other embodiment, a fan-like shade is contained within the arcuate opening and is fastened to the back side of a face frame in a fixed closed position.

(2) In each of the embodiments described above, the blinds or shades are contained within a frame sized and configured to fit within the existing frame of an existing window for easy assembly. Each of these systems is easily fabricated based upon known dimensions of an existing window so that they fit comfortably and accurately therein.

(3) In the embodiment wherein the shade system is of a fan-type a pair of centrally located, spaced, upstanding arcuate hubs are provided that facilitate support of the fan-shaped shade to eliminate a space that the shade material creates.

(4) In a further aspect, a decorative molding is provided to be installed within the inner walls of the existing window frame to provide an aesthetic appearance in front of the shade assembly that is installed therein.

Accordingly, it is a first object of the present invention to provide a modular window shade assembly.

It is a further object of the present invention to provide such an assembly wherein a pre-formed shade assembly contained within its own frame is easily installed within the existing frame of an existing window.

It is a still further object of the present invention to provide such a shade assembly with a molding installed on the existing window frame to provide an aesthetic appearance for the shade assembly.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
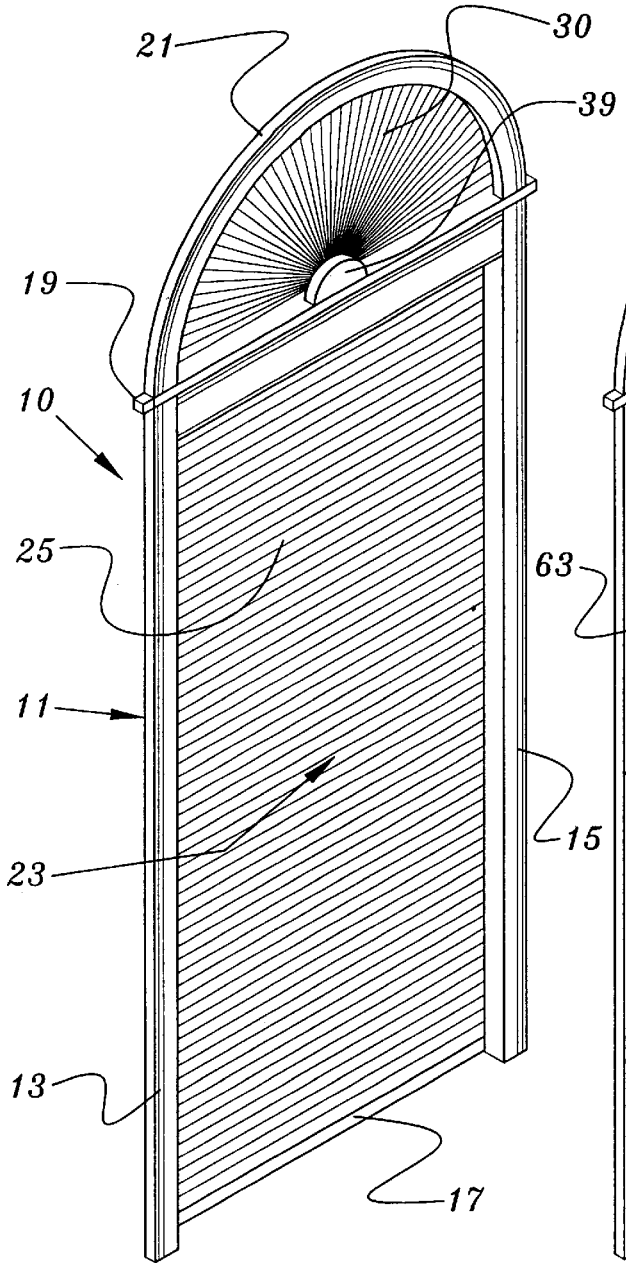
FIG. 1 shows a perspective view of a first embodiment of window shade assembly in accordance with the teachings of the present invention.
Figures 3, 4:
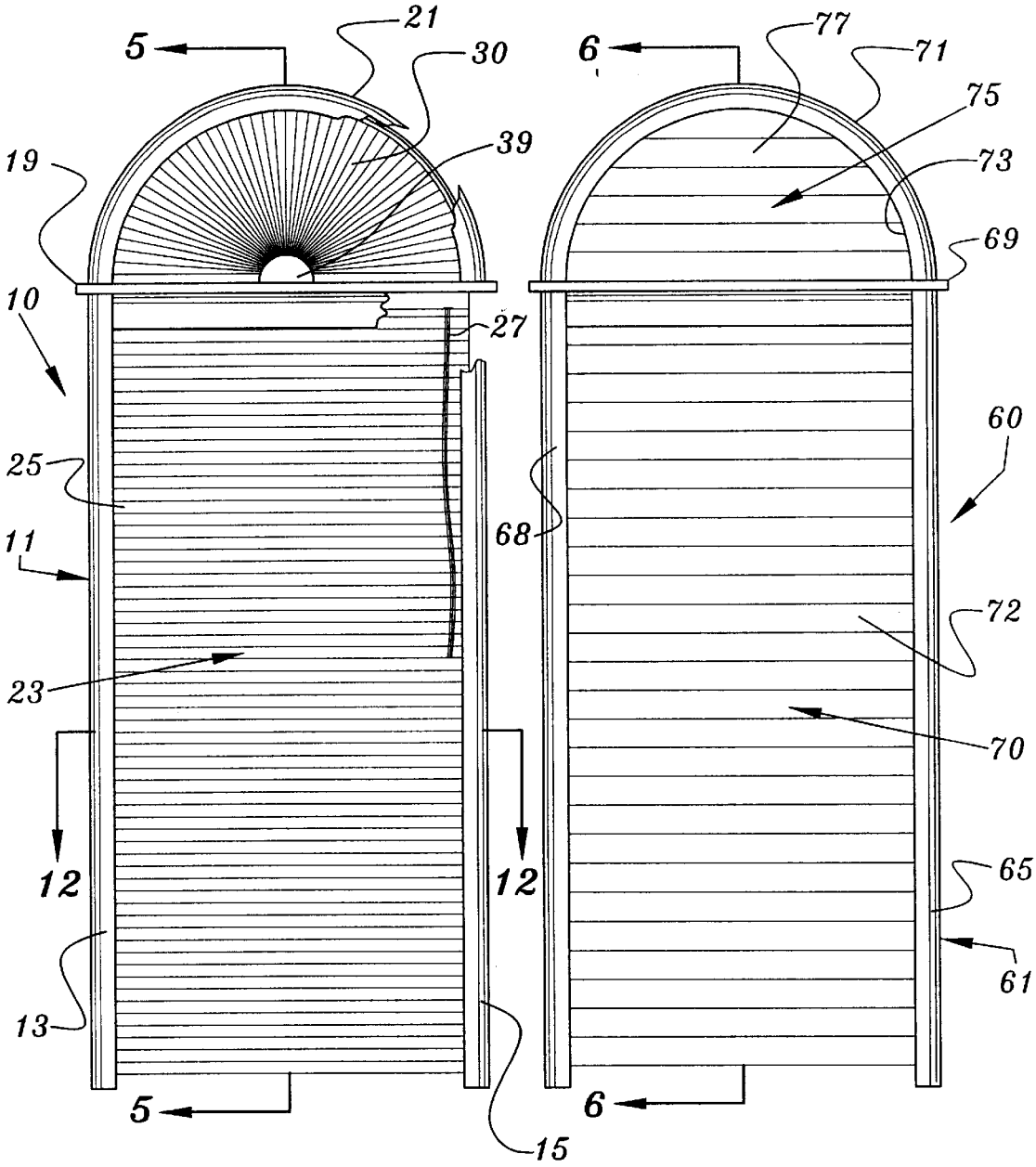
FIG. 3 shows a front view of the embodiment of FIG. 1.
FIG. 4 shows a front view of the embodiment of FIG. 2.
Figure 5:
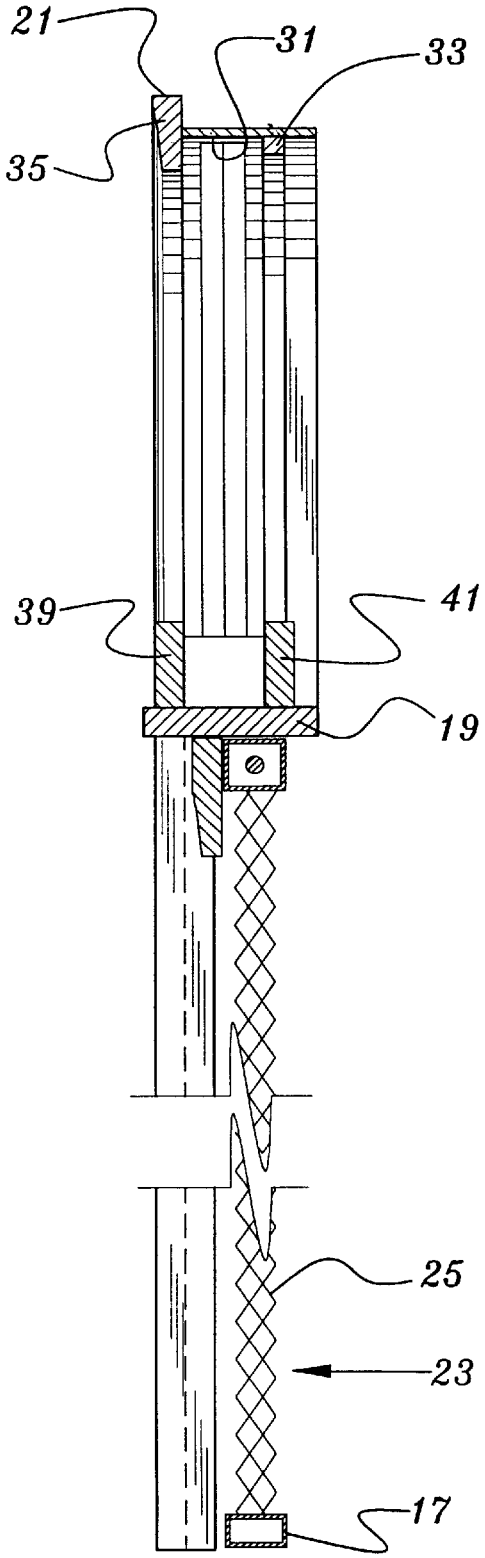
FIG. 5 shows a cross-sectional view along the line 5—5 of FIG. 3.

With reference, first, to FIGS. 1, 3 and 5, a first embodiment of shade assembly is generally designated by the reference numeral 10 and is seen to include a frame 11 having two straight vertical frame members 13 and 15, a horizontal bottom frame member 17, a horizontal top frame member 19, and an arcuate upper frame member 21. The upper frame member 21 can be a semicircle or tending more towards an elliptical shape.

Disposed within the frame members 13, 15, 17 and 19 is a generally rectangular shade 23 having slats 25 (FIG. 1) and provided with a cord 27 (FIG. 3) that is pulled to lift the shade assembly 23 or lower it, as the case may be, in a manner well known to those skilled in the art.

With further reference to FIGS. 1, 3 and 5, the arcuate upper frame 21 encloses a sun shade element which is a fan-like shade 30 having a pleated configuration.

Figure 7:
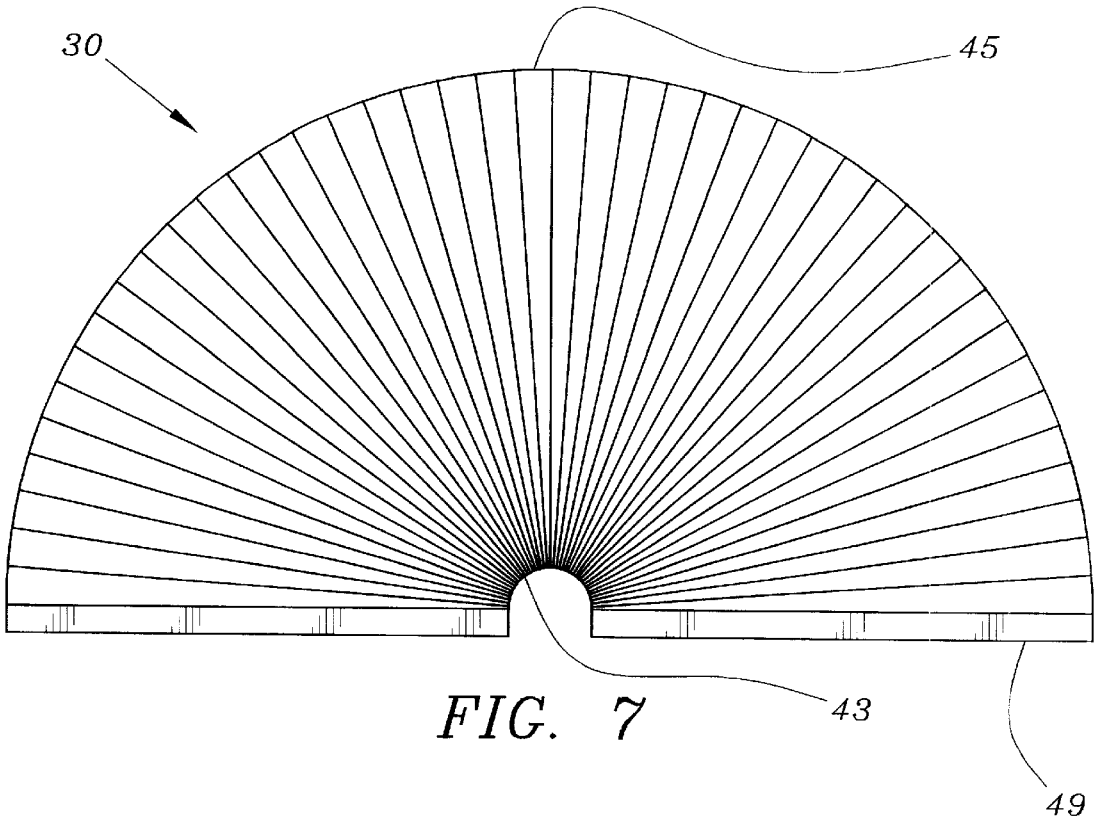
FIG. 7 shows an enlarged front view of the fan-type shade assembly of FIGS. 1 and 3.
Figure 8:
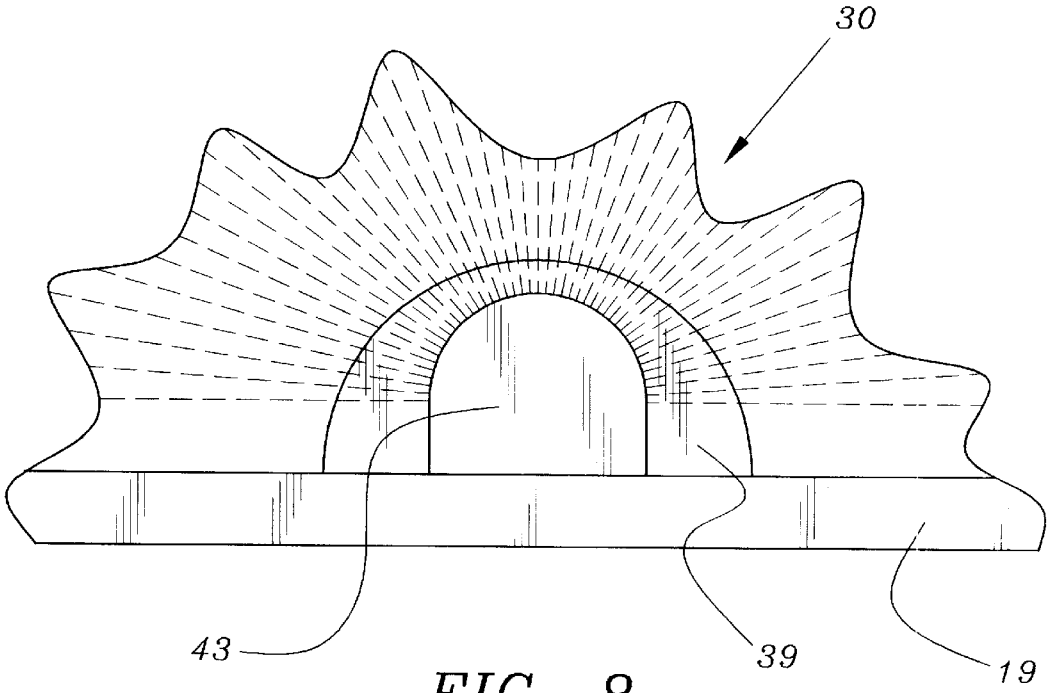
FIG. 8 shows a view similar to that of FIG. 7 but further enlarged to show details of the central hub thereof.
Figure 9:
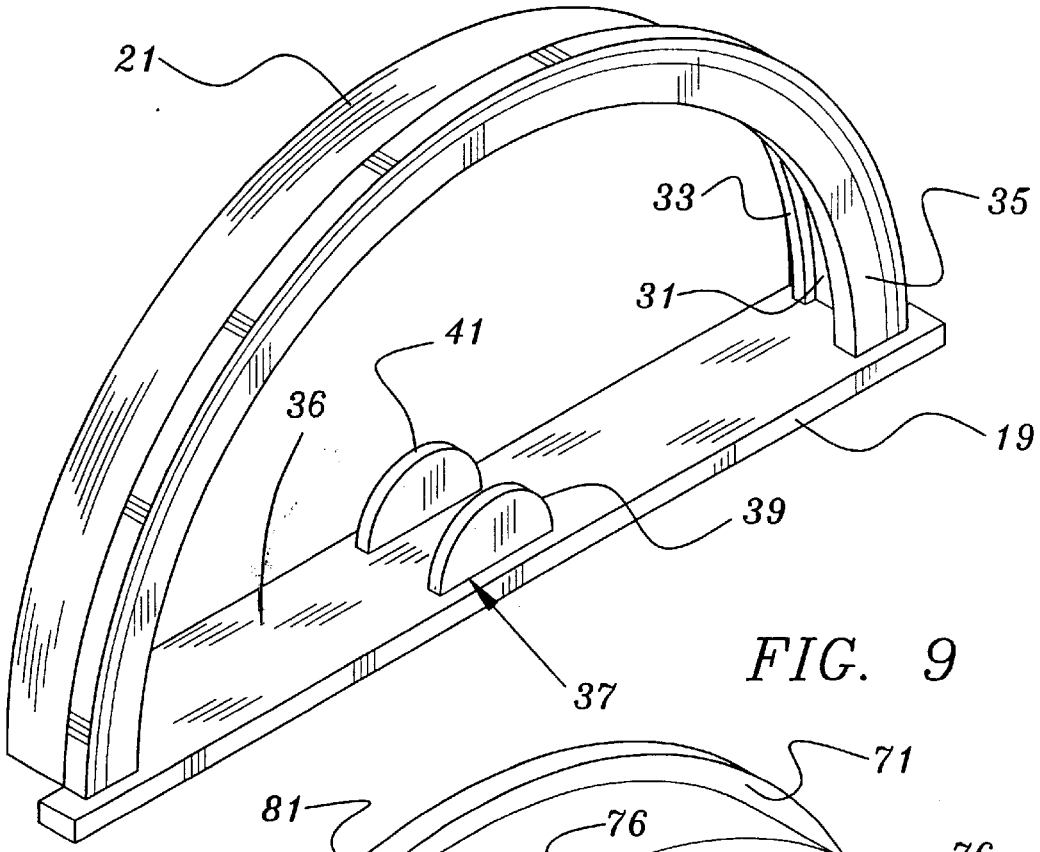
FIG. 9 shows a perspective view of the frame for the fan-type shade best seen in FIGS. 7 and 8.

With reference to FIG. 9, in particular, the frame 21 has an internal channel 31 surrounded by a rear molding 33 and a front molding 35. A support hub 37 is mounted on an upper surface 36 of the horizontal frame member 19 and includes two spaced upstanding arcuate hubs 39 and 41. With reference to FIGS. 7 and 8, the shade 30 has a semi-circular recess 43 adapted to fit between the hubs 39 and 41 as best seen with reference to FIG. 8. The peripheral edge 45 of the shade 30 (FIG. 7) fits within the channel 31 of the frame 21 as enclosed therein by the moldings 33 and 35 and is fastened to a back surface of molding 35. The shade 30 is enclosed between the hubs 39 and 41 to prevent light transmission therethrough. The shade 30 has a bottom edge 49 (FIG. 7).

Figure 2:
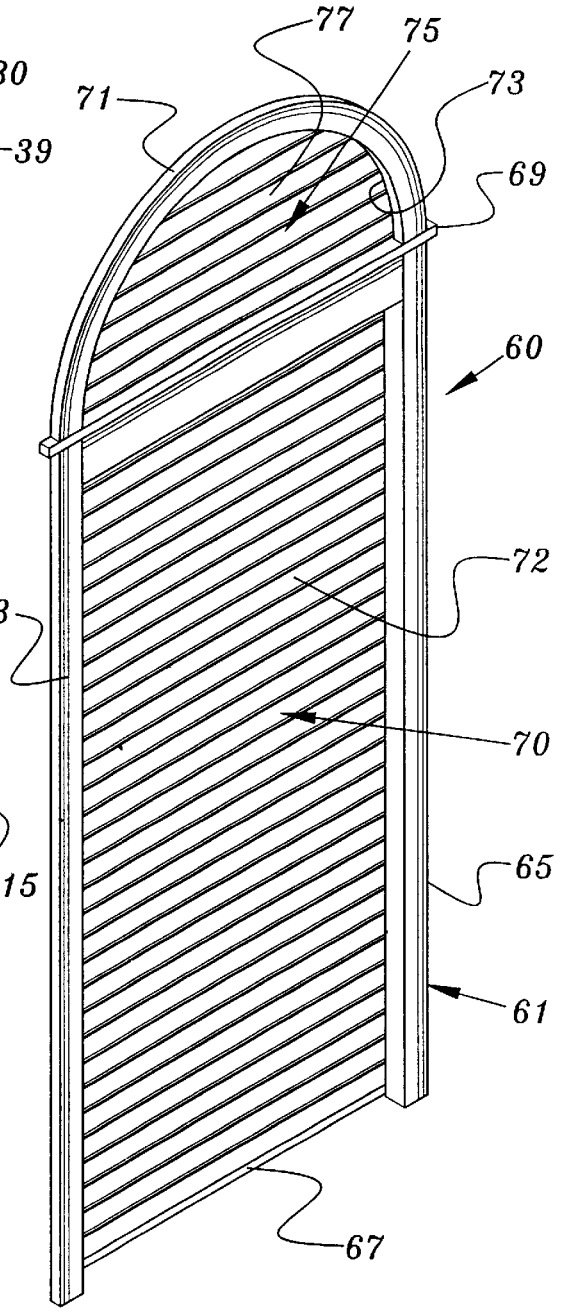
FIG. 2 shows a perspective view of a second embodiment of window shade assembly in accordance with the teachings of the present invention.
Figure 6:
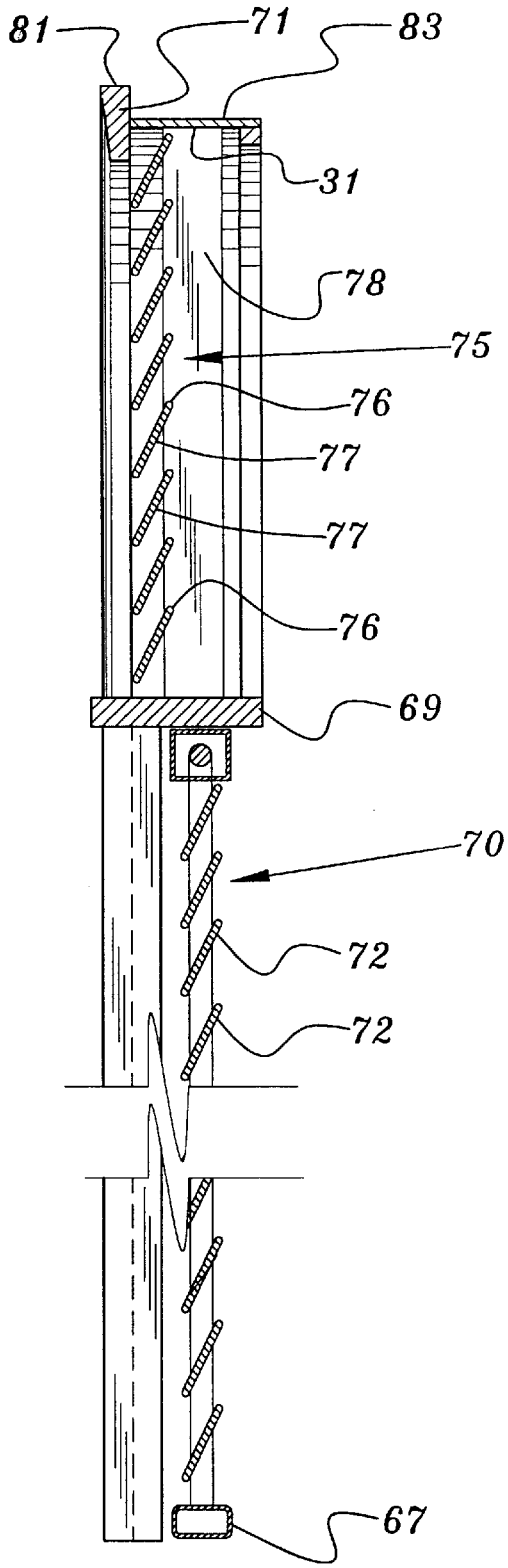
FIG. 6 shows a cross-sectional view along the line 6—6 of FIG. 4.

With reference, now, to FIGS. 2, 4 and 6, the second embodiment of modular window shade assembly in accordance with the teachings of the present invention is generally designated by the reference numeral 60 and is seen to include a frame 61 including vertical frame members 68 and 65, horizontal frame members 67 and 69, and an arcuate upper frame member 71. Within the frame members 63, 65, 67 and 69 is a generally rectangular shade assembly 70 including a plurality of horizontal slats 72 pivotable or reciprocable to allow adjustments of light transmission through the opening formed by these frame members.

Figure 13:
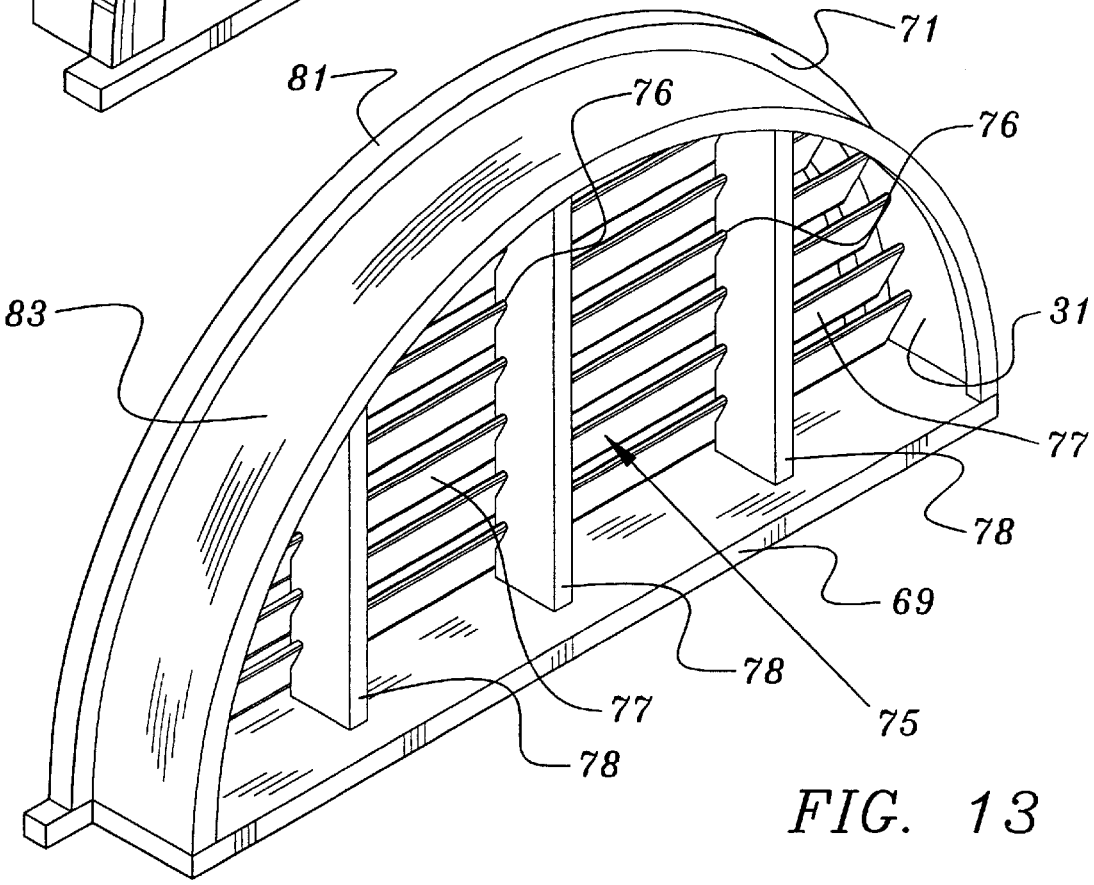
FIG. 13 is a rear isometric view of the shade assembly of FIG. 2.

Above the top horizontal frame member 69 and within the upper arcuate frame member 71, a substantially semicircular opening 73 is provided that contains a substantially semicircular sun shade element which is a blind assembly 75 having a plurality of horizontal slats 77 as best seen in FIGS. 2 and 13. These slats are fixed. The slats 77 are supported within grooves 76 in vertical members 78. As seen in FIG. 13, about three vertical members 78 can support slats 77. However, additional vertical members 78 can be employed.

As best seen in FIG. 6, the upper frame assembly 71 includes a molding 81 that is aesthetically pleasing and a semicircular portion 83 behind the molding 81 and enclosing the opening 73.

Figure 12:
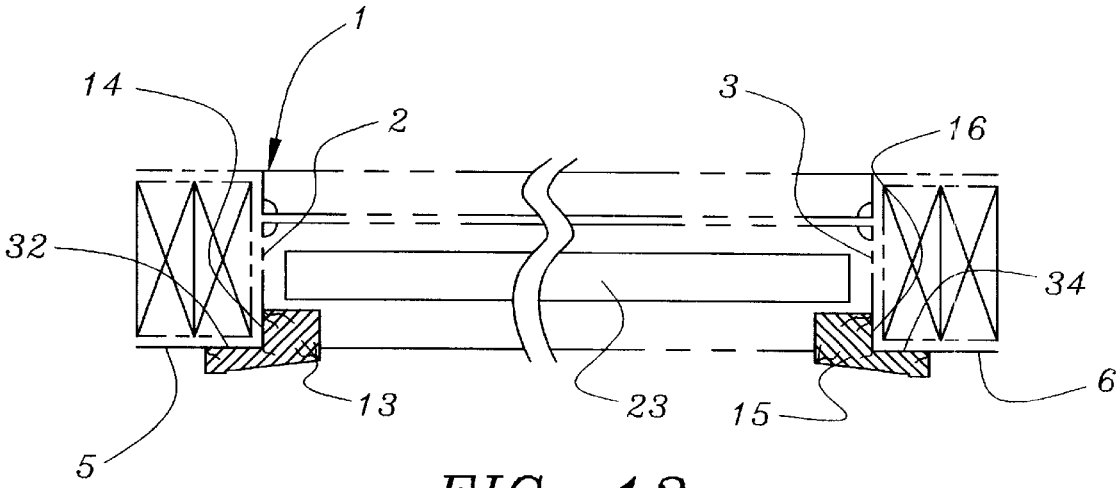
FIG. 12 shows a cross-sectional view along the line 12—12 of FIG. 3.

With reference to FIG. 12, the frame members 13 and 15 are seen to include an L-shaped cross-section. In FIG. 12, the existing window frame is designated by the reference numeral 1 and includes inner walls 2, 3 that receive outer surfaces 14, 16 of the frame members 13 and 15. The frame members 13 and 15 also include rear faces 32 and 34 that abut against front surfaces 5 and 6, respectively, of the existing window frame 1. The frame members 13, 15 as depicted in FIG. 12, are shown as separate aesthetic elements unconnected to the support for the shade assembly 23. If desired, the frame members 13 and 15 may be separate structures merely provided for aesthetics or may be integrally formed with the structure that supports the shade assembly 23.

Figure 10:
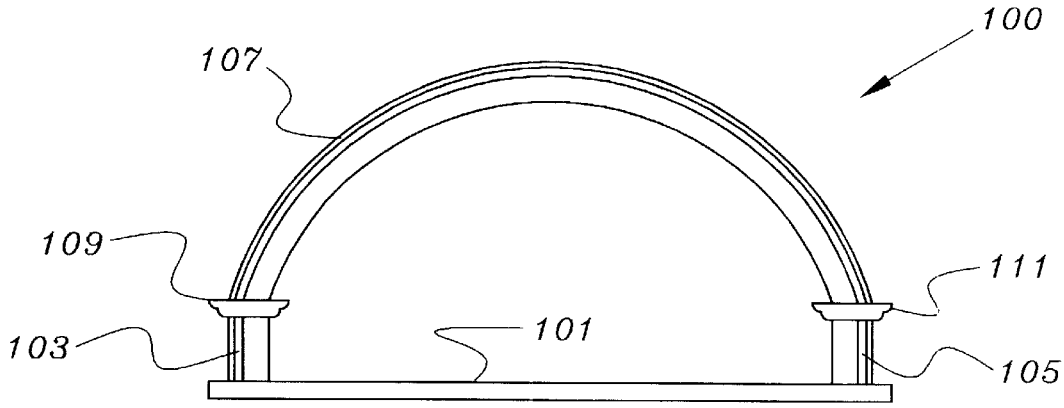
FIG. 10 shows a front view of an example of a molding usable to provide aesthetic appeal to the shade assemblies of FIGS. 1 and 2.
Figure 15:
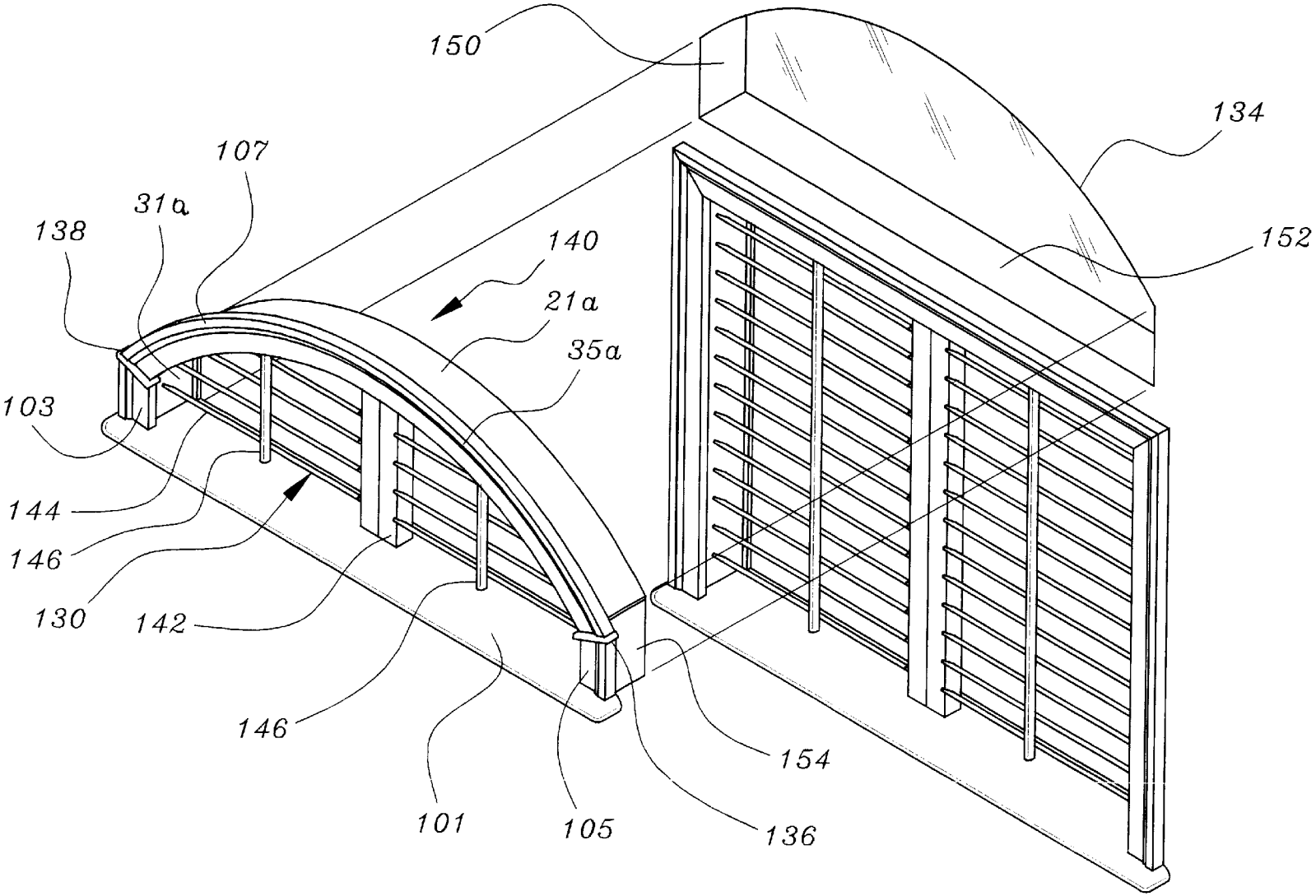
FIG. 15 shows the frame of FIG. 11 being inserted into a wall opening containing a window.
Figure 16:
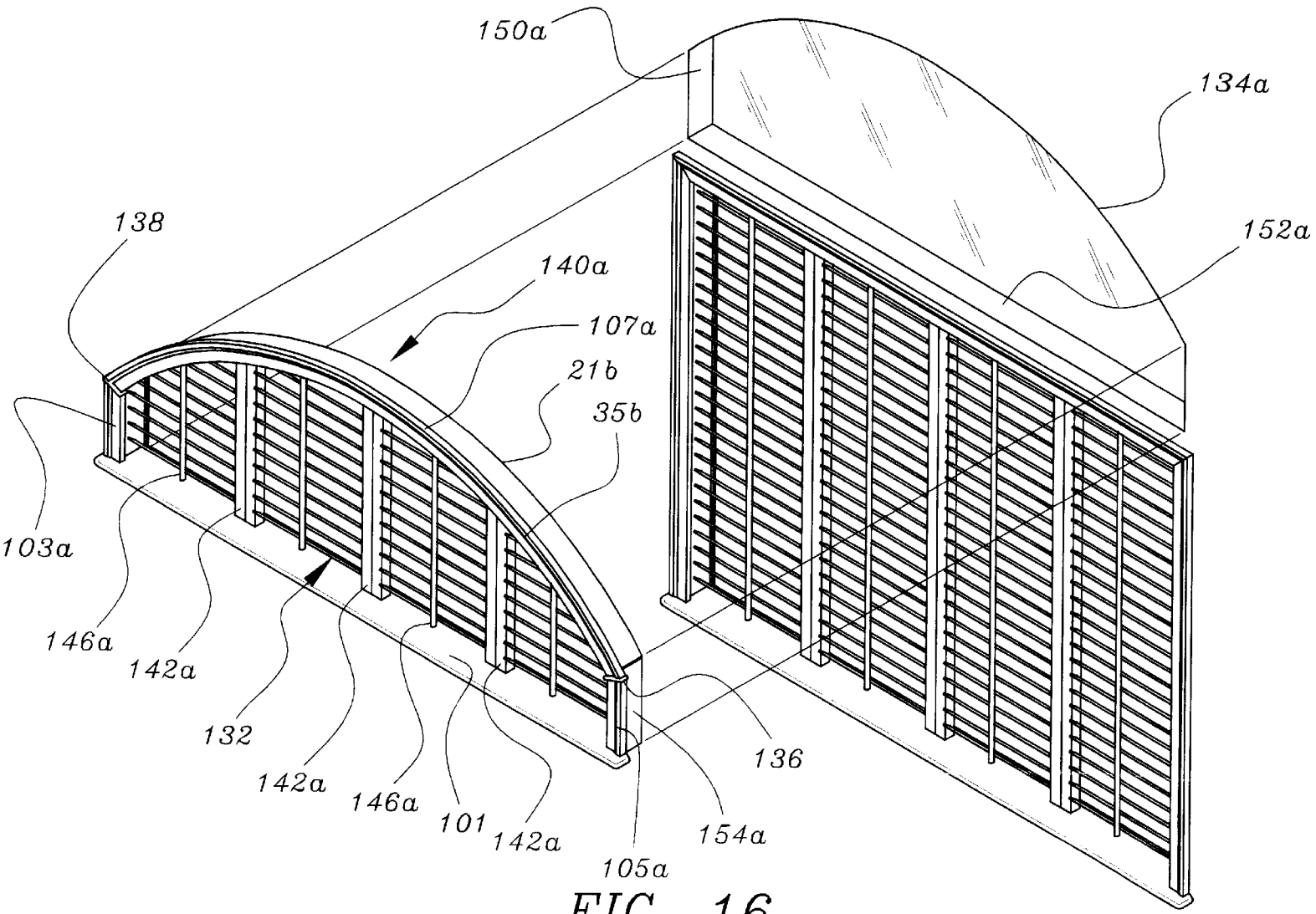
FIG. 16 shows a frame having an extended longitudinal shutter section being inserted into a wall opening containing a window.

FIG. 10 shows a front view of a molding assembly 100 having the same cross-sectional configuration as the frame members 13 and 15 depicted in FIG. 12 and designed to cover an existing semi-circular opening 134 or 134*a* at the top of a window frame for aesthetic purposes as seen in FIGS. 15 and 16. FIG. 16 also shows shade assembly 132 and front molding 107*a*. The molding assembly 100 includes a horizontal portion 101, vertical portions 103 and 105, an arcuate portion 107, and horizontal portions 109 and 111 as seen in FIG. 10 or angled trim portions 136 and 138 seen in FIGS. 14–17. The molding 100 is installed within an existing window frame in the manner explained with reference to FIG. 12.

Figure 11:
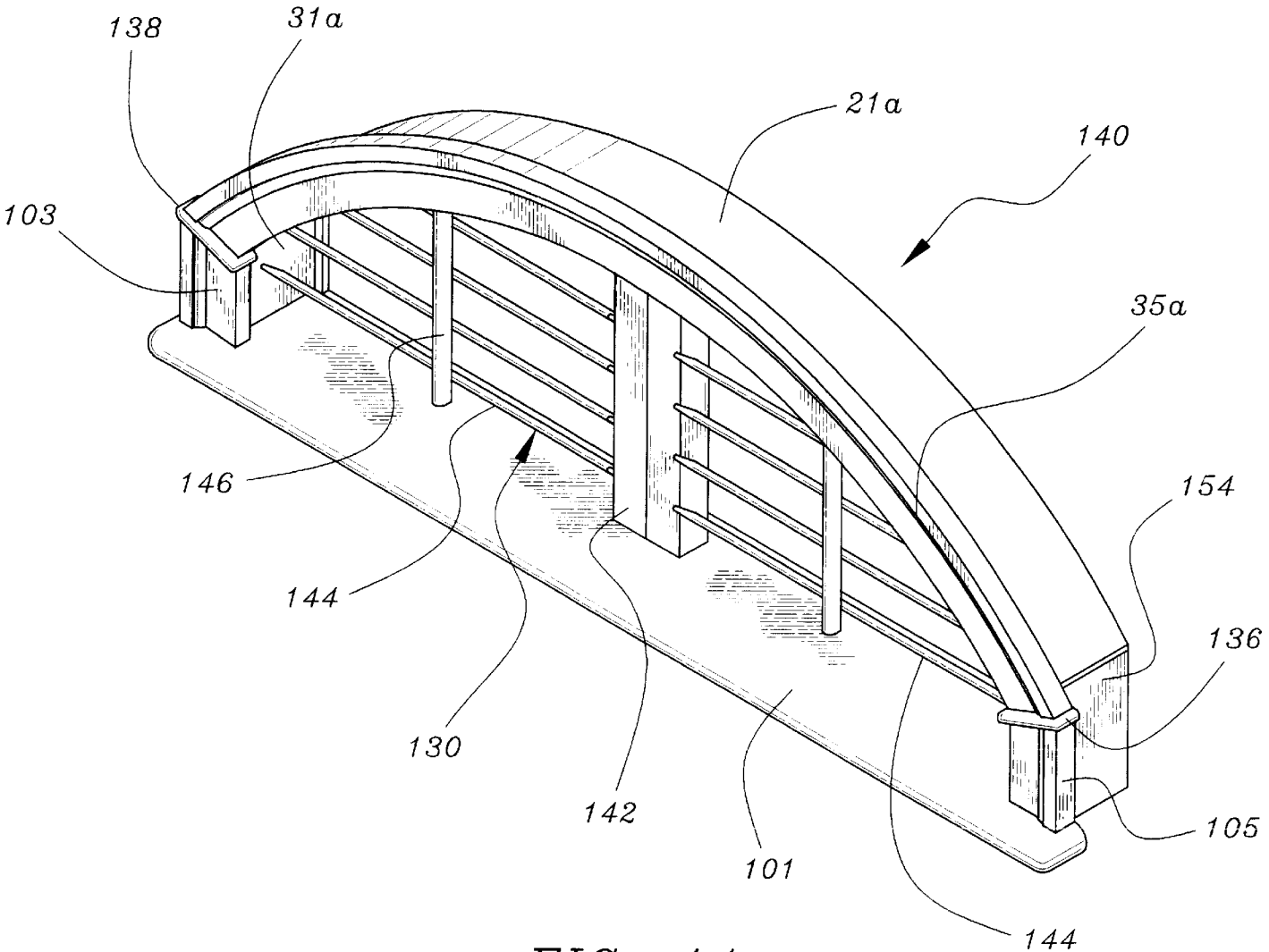
FIG. 11 is an alternate frame assembly ready for placement in a wall opening to a window with shutters partially closed.
Figure 14:
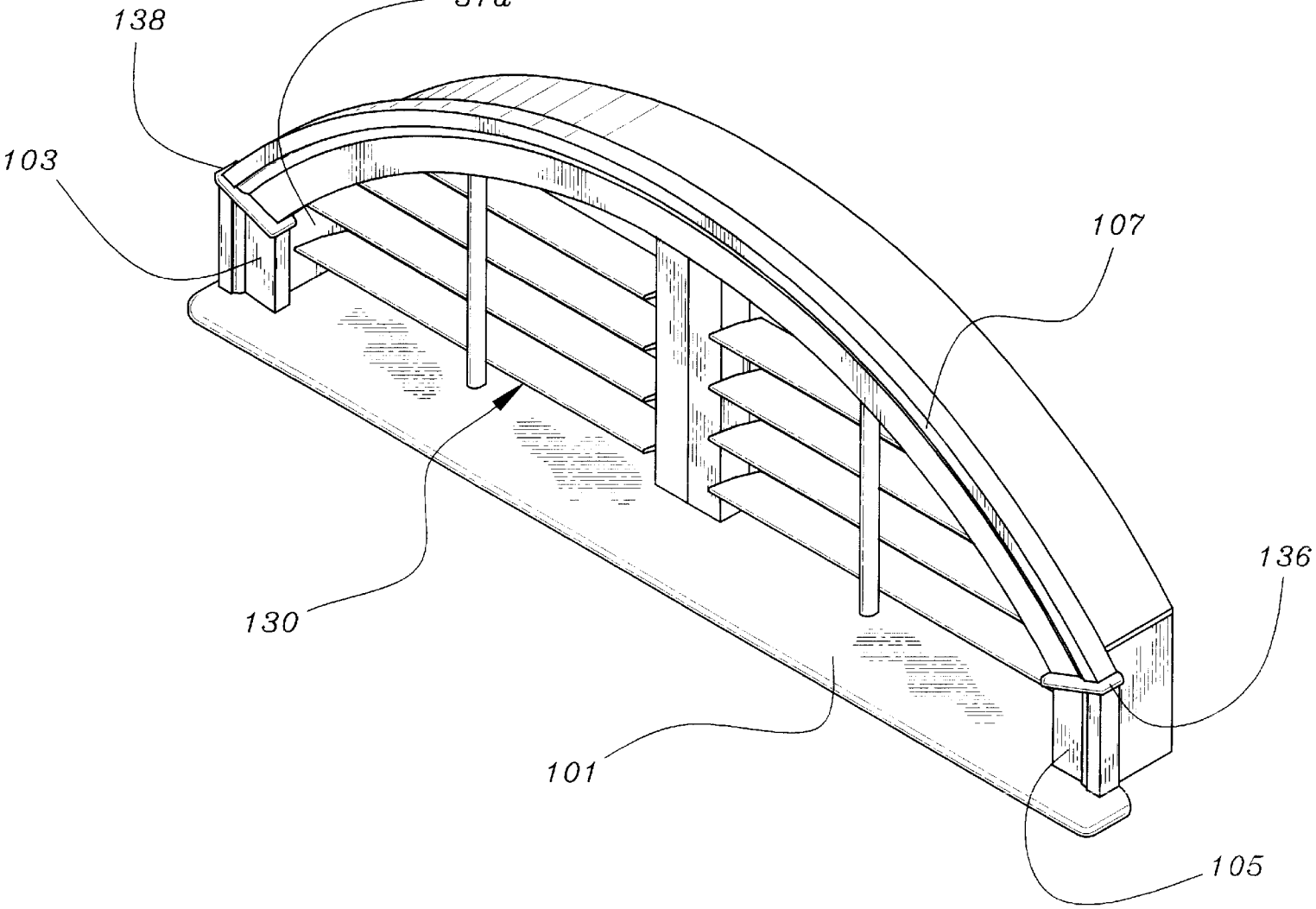
FIG. 14 is the alternate frame shown in FIG. 11, with the shutters open.
Figure 17:
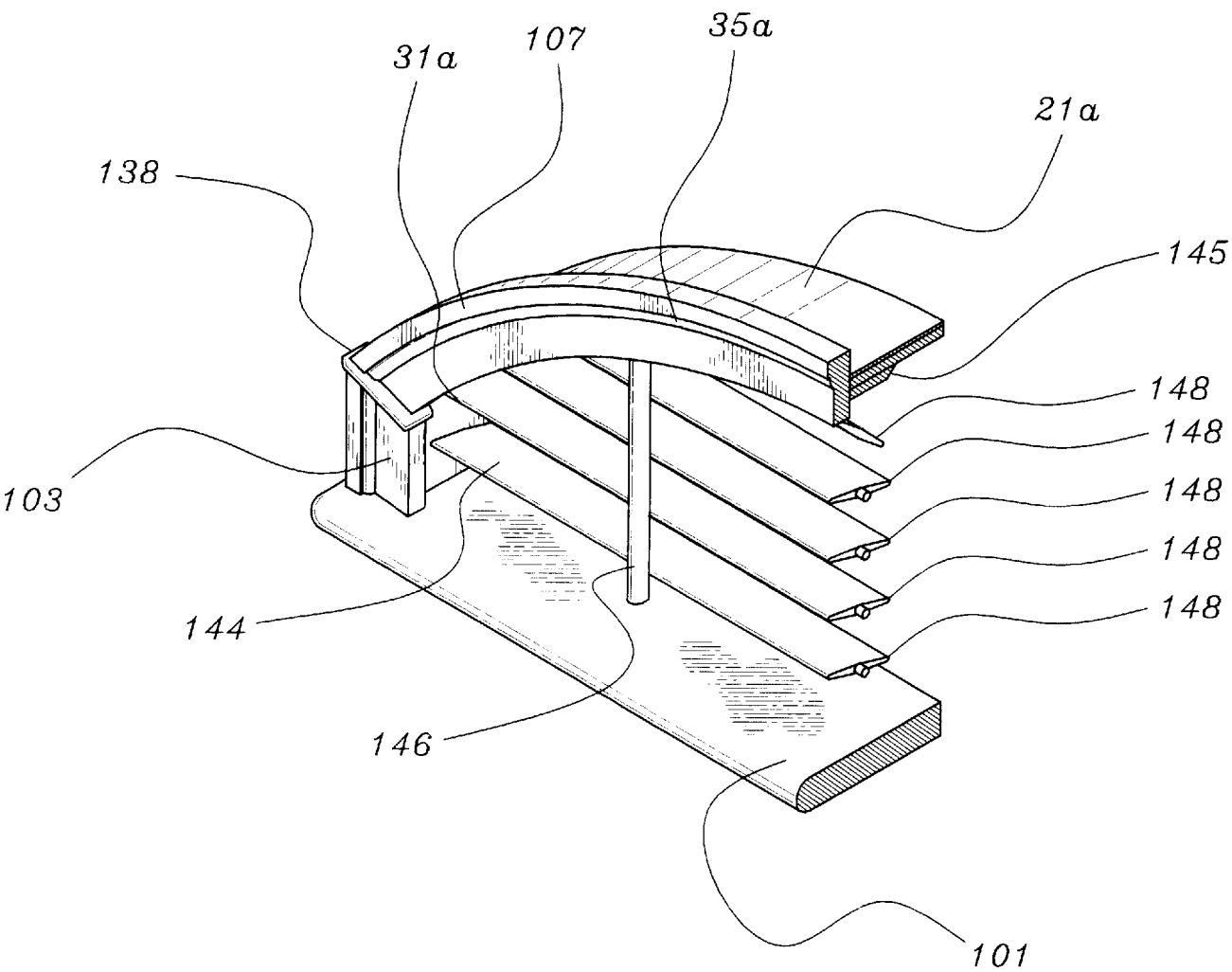
FIG. 17 shows a partial section of the frame shown in FIG. 11.

FIG. 11 shows a modified frame assembly 140 having an upper frame member 21*a*, a front molding 35*a*, a vertical center post 142, movable shutters 144 and vertical hand rods 146 to control movement of the shutters 144. The shutters 144 pivot on each side by pivot pins 148 as shown in FIG. 17.

Multiple vertical posts 142*a* can be employed to widen the frame assembly 140*a* as seen in FIG. 16. Additional hand rods 146*a* and expanded shutter assembly 132 are employed with frame assemble 140*a*.

Figure 18:
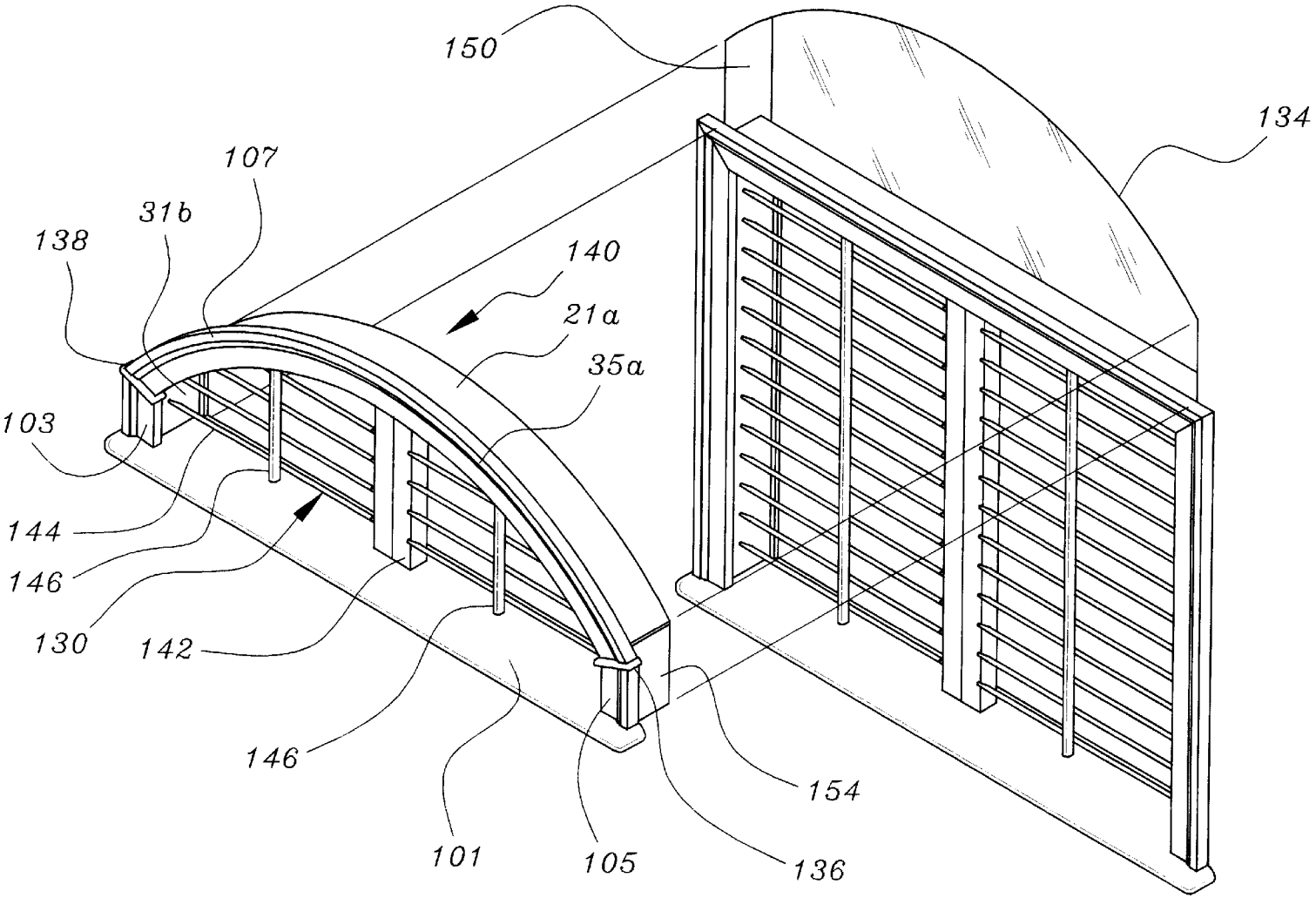
FIG. 18 shows a frame of FIG. 11 being inserted in a wall opening directly over a lower rectangular shade.
Figure 19:
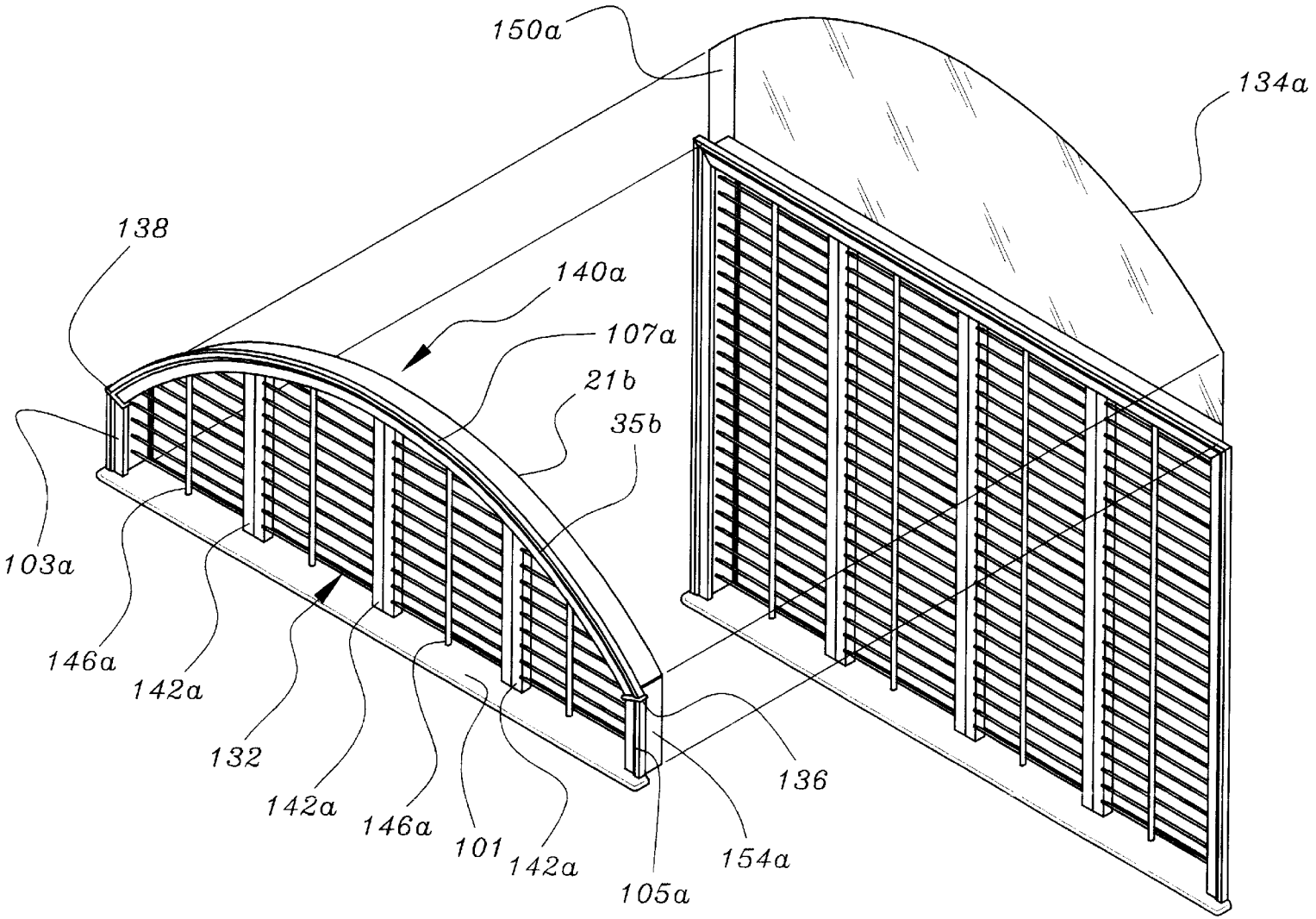
FIG. 19 shows a frame having an extended longitudinal shutter section being inserted into a wall opening directly over a lower rectangular shade.
Figure 20:
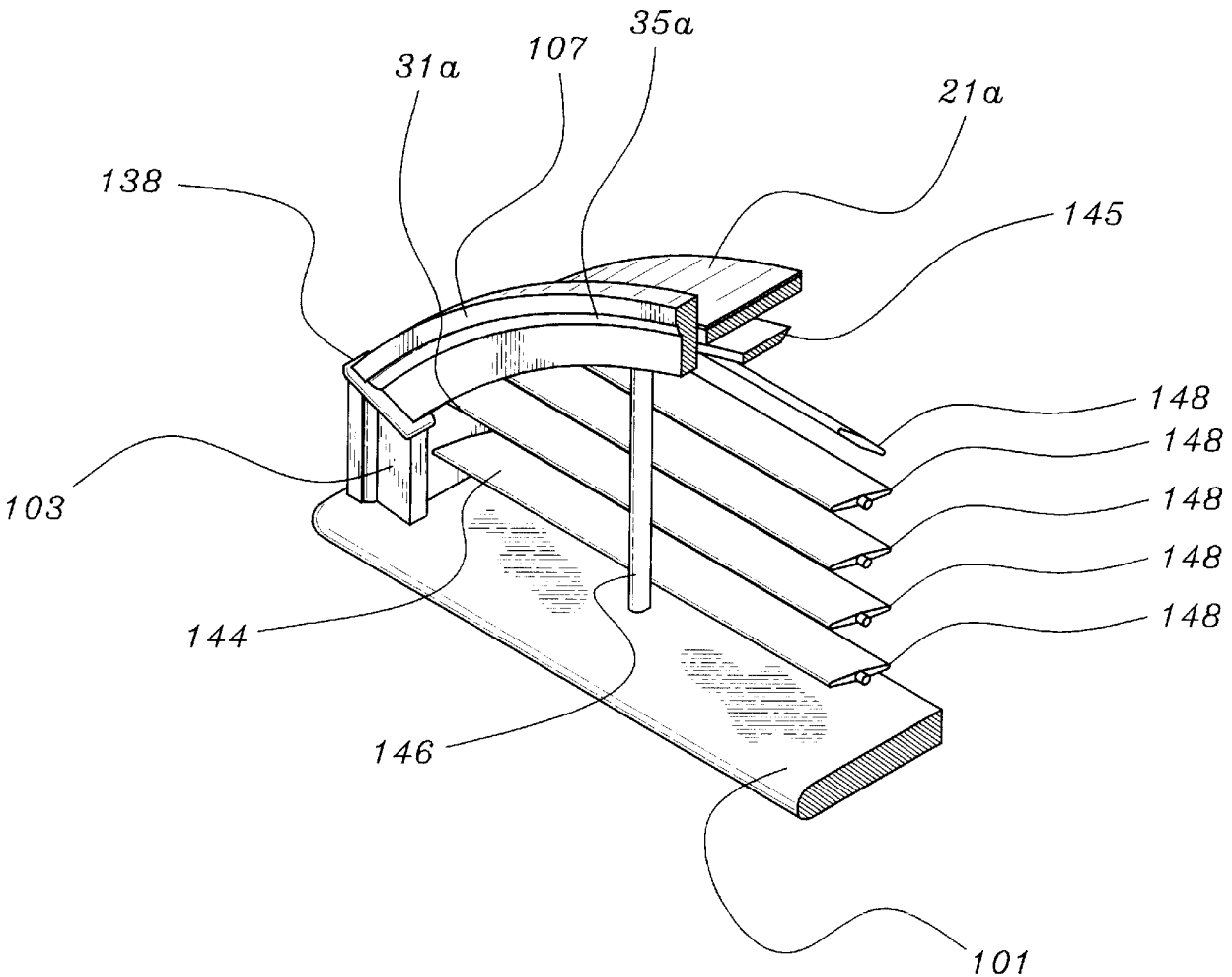
FIG. 20 shows a further partial section of the frame shown in FIG. 11.

The frame assembly 140 shown in FIGS. 11 and 15 contains a shade element assembly 130 having a central vertical post 142 with side holes (not shown) in which pins 148 (FIG. 17) pivot. In like manner, the side wall 31*a* contains opposed holes for receipt of shutter pivot pins. Arcuate member 145 above side wall 31*a* also contains holes for shutter pins. In this way, the shutters 144 open and close in response to movement of hand rods 146. The frame assembly 140, as shown in FIG. 15, has a side wall 31*b* and is designed for placement in a wall opening having a side wall 150 corresponding to the exterior side wall 154 of frame assembly 140. A portion of the horizontal base 101 of the frame 140 rests on and is fastened to the window sill 152, or on top of the shutter frame as shown in FIGS. 18 and 19. The frame assembly 140 rear portion is juxtaposed against the window 134.

In a wider version of a frame assembly 140*a* the exterior side wall 154*a* of the frame 140*a* conforms to the window frame. The upper frame member 21*b* conforms in depth to the window sill 152*a* so that front molding 35*b* covers any space between side wall 154*a* and side wall 150*a*. The frame assembly 140*a* has longer vertical connecting members 105*a* and 103*a* than in frame assembly 140.

The frame assembly 140 or 140*a* can be easily removed from sills 152 or 152*a* respectively, for cleaning of the assembly 140 or 140*a* and the window 134 or 134*a* respectively, merely by pulling the frame assembly outwardly away from the window 134 or 134*a*. The frame assembly 140 or 140*a* can be fastened to the window sill 152 or 152*a* with easily removable screws or in like manner to the top of a lower frame assembly.

In accordance with the teachings of the present invention, an existing window frame is augmented through the addition of a modular window shade assembly sized and configured to exactly fit the dimensions of the window frame opening for ease of installation and for enhancement of aesthetics. Either the fan-shaped shade assembly 30 of FIG. 1 or the similarly shaped but differently operating shade assembly 75 of FIG. 2 may be suitably employed within the arcuate opening thereof, but in each instance the shade assembly is not attached to control ropes or pulleys.

In the preferred embodiment of the present invention, the structural portions of the frame of the inventive window shade assembly can be made of suitable wood materials, although plastic such as polyvinyl chloride and metal also can be employed.

As such, an invention has been disclosed in terms of preferred embodiments thereof which fulfill each and every one of the objects of the invention as set forth hereinabove and provide a new and useful modular window shade assembly of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. A modular window shade assembly mounted juxtaposed to an interior surface of a window in a window access opening in a wall, comprising:

(a) a frame having an arcuate frame component connecting to a flat bottom frame member, the flat bottom frame member having a generally rectangular shape conforming in shape to a corresponding window sill;

(b) a channel formed by an arcuate inner wall surface of said arcuate frame component and a rear wall of said front molding and a front wall of said rear molding, said front and rear moldings being attached to the arcuate frame component, said rear molding being attached to said inner wall surface of said arcuate frame component at a location such that a rear wall of said rear molding is forward of a rear edge of said arcuate frame component, said arcuate inner wall being defined by at least one radius of curvature, said channel being laterally closed and inwardly open solely in a radial direction;

(c) a sun shade element having an arcuate outer periphery and being fixedly mounted within the frame and the outer periphery being radially received within and guided by the channel;

(d) the modular window shade assembly being mounted as an integral unit in the window access opening in the wall, but removable for cleaning of the modular window shade assembly and the interior surface of the window.

2. The modular window shade assembly according to claim 1, wherein an upright side member connects the arcuate frame member at a first and second end respectively, to the flat bottom frame member.

3. The modular window shade assembly according to claim 2, wherein the sun shade element mounted within the frame is a fixed fan-shaped shade.

4. The modular window shade assembly according to claim 2, wherein the sun shade element mounted within the frame consists of multiple horizontal slats mounted in grooves formed in at least one fixed vertical member connecting the multiple horizontal slats in parallel on a back portion of the frame assembly and the multiple horizontal slats having a narrower longitudinal length from the lower portion of the arcuate frame component to a top of the arcuate frame component with an outer end of each slat positioned within the channel.

5. The modular window shade assembly according to claim 2, wherein the sun shade element mounted within the frame consists of multiple horizontal slats movably mounted between the inner wall of the channel and a side wall of an upright intermediate member connecting a portion of the arcuate frame component to the flat bottom frame member.

6. The modular window shade assembly according to claim 5, wherein there are multiple intermediate parallel members connecting a portion of the arcuate frame component to the flat bottom frame member and multiple horizontal slats are movably mounted between the intermediate parallel members.

7. The modular window shade assembly according to claim 1, wherein the sun shade element mounted within the frame is a fixed fan-shaped shade.

8. The modular window shade assembly according to claim 1, wherein the sun shade element mounted within the frame consists of multiple horizontal slats mounted in grooves formed in at least one fixed vertical member connecting the multiple horizontal slats in parallel on a back portion of the frame assembly and the multiple horizontal slats having a narrower longitudinal length from the lower portion of the arcuate frame component to a top of the arcuate frame component with an outer end of each slat positioned within the channel.

9. The modular window shade assembly according to claim 1, wherein the sun shade element mounted within the frame consists of multiple horizontal slats movably mounted between the inner wall of the channel and a side wall of an upright intermediate member connecting a portion of the arcuate frame component to the flat bottom frame member.

10. The modular window shade assembly according to claim 9, wherein there are multiple vertical intermediate parallel members connecting a portion of the arcuate frame component to the flat bottom frame member and multiple horizontal slats are movably mounted between the intermediate parallel members.

11. A modular window shade system mounted juxtaposed to an interior surface of a window in a window access opening in a wall, the system comprising:

(a) a frame having an arcuate frame component with an arcuate inner wall surface, said frame connecting to a flat bottom frame member, the flat bottom frame member having a generally rectangular shape conforming in shape to a corresponding window sill;

(b) a front molding of the arcuate frame component attached to a forward edge of said arcuate frame component and extending radially inwardly and radially outwardly of said forward edge;

(c) a sun shade element fixedly mounted within the frame with an outer periphery of the sun shade element being closely adjacent said arcuate inner wall surface and being hidden from outside view by a radially inwardly extending portion of the front molding; and (d) the modular window shade system mounted as an integral unit in the window access opening in the wall with a radially outwardly extending portion of said front molding overlying a portion of said wall, said system being removable for cleaning of the modular window shade system and the interior surface of the window.

12. The modular window shade system according to claim 11, wherein an upright side member connects the arcuate frame member at a first and second end respectively, to the flat bottom frame member and the front molding overlaps and extends outwardly from a front wall of the upright side member.

13. The modular window shade system according to claim 11, wherein the flat bottom frame member is fastened with screws to a window sill.

14. The modular window shade system according to claim 11, wherein the flat bottom frame member is fastened with screws to a top portion of a lower window shade assembly.

* * * * *